United States Patent [19]

Berkel

[11] 4,294,359

[45] Oct. 13, 1981

[54] RESHIPPER CARTON FOR FINISHED OR UNFINISHED TV BULBS

[75] Inventor: Michael R. Berkel, Circleville, Ohio

[73] Assignee: Owens-Illinois, Inc., Toledo, Ohio

[21] Appl. No.: 116,332

[22] Filed: Jan. 28, 1980

[51] Int. Cl.[3] ..... B65D 85/42

[52] U.S. Cl. ..... 206/422; 206/426; 229/15; 229/29 D; 229/22

[58] Field of Search ..... 206/420, 421, 422, 426; 229/15, 29 D, 22

[56] References Cited

U.S. PATENT DOCUMENTS

| | | | |
|---|---|---|---|
| 2,097,757 | 11/1937 | Deike | 206/422 |
| 2,690,254 | 9/1954 | White | 206/422 |
| 3,145,836 | 8/1964 | Tyrseck et al. | 206/422 |
| 3,758,020 | 9/1973 | Childs et al. | 206/422 |
| 3,822,785 | 7/1974 | Getz et al. | 206/422 |
| 4,058,206 | 11/1977 | Morse et al. | 229/15 |

FOREIGN PATENT DOCUMENTS

| | | | |
|---|---|---|---|
| 571145 | 2/1959 | Canada | 229/15 |
| 725809 | 3/1955 | United Kingdom | 229/15 |

*Primary Examiner*—Joseph Man-Fu Moy

*Attorney, Agent, or Firm*—John R. Nelson; Myron E. Click; David H. Wilson

[57] ABSTRACT

This invention provides an improved reshipper carton which is capable of providing adequate shipping protection for either finished color TV bulbs, which have a large rectangular face plate end tapering down to an integral neck tubulation, or for unfinished TV bulbs or funnels, which have a large rectangular end and an integral neck tubulation but do not have a face plate secured thereto. The invention contemplates dividing the volume of a rectangular space defined by vertical corrugated walls of a container into two generally triangular compartments through the insertion of a vertical partition in diagonal relationship across the corners of the container. Such partition is provided with scores that permits two flaps to be horizontally displaced outwardly from opposite sides of the partition into respective engagement with the adjacent side walls of the compartment. Each flap is provided with a means for engaging the neck tubulation of a TV bulb or funnel and will provide secure mounting of the TV bulb or funnel within the triangular compartment defined by the diagonal partition.

15 Claims, 5 Drawing Figures

RESHIPPER CARTON FOR FINISHED OR UNFINISHED TV BULBS

BACKGROUND OF THE INVENTION

The manufacture of color television tubes is generally accomplished in two different plants, necessitating the shipment of the glass components of the color TV bulb from the glass producing plant to a bulb assembly plant. The glass producing plant normally produces a glass funnel, having a relatively large, generally rectangular viewing end portion to which a face plate is eventually integrally attached, and tapering down to an integral end tubulation. Heretofore, it has been necessary to provide special corrugated containers to effect the shipment of the unfinished TV funnels to the bulb assembly plant, and, after assembly of the face plate to the funnel and insertion of the electronic components in the end of the neck tubulation, a carton is employed to ship the finished bulb to the set manufacturer. There is a distinct need for an improved corrugated reshipper box which can be employed not only to ship the unfinished TV funnel from the glass plant to the tube assembly plant, but can also be employed to ship the finished tube to the TV set manufacturer, or to a ware house handling replacement tubes, as the case may be.

SUMMARY OF THE INVENTION

This invention provides an improved reshipper carton which is capable of providing adequate shipment protection for either finished color TV bulbs, which have a large rectangular face plate end tapering down to an integral neck tubulation, or for unfinished TV bulbs or funnels, which have a large rectangular end and an integral neck tubulation but do not have a face plate secured thereto. The invention comprises an outer corrugated box of rectangular configuration, having a bottom and side walls, which outer box contains a plurality of rectangular corrugated tubes, mounted side by side, with the walls of said rectangular tubes vertically disposed. Each said rectangular tube is divided into two equal triangular compartments by a vertical corrugated partition, extending diagonally between two corners of said rectangular tube. Each said vertical diagonal partition is scored so that two integral flaps may be folded outward in a horizontal plane in opposite directions, to engage opposite side walls of said rectangular tube. Each flap is provided with a means for engaging the neck tubulation of a TV bulb and will provide secure mounting of the TV bulb within the triangular compartment defined by the diagonal partition.

An object of the invention is to provide simplified assembly from a small number of corrugated parts, of a reshipper carton capable of accomodating both finished and unfinished TV bulbs.

DESCRIPTION OF PREFERRED EMBODIMENT

Figure 1:
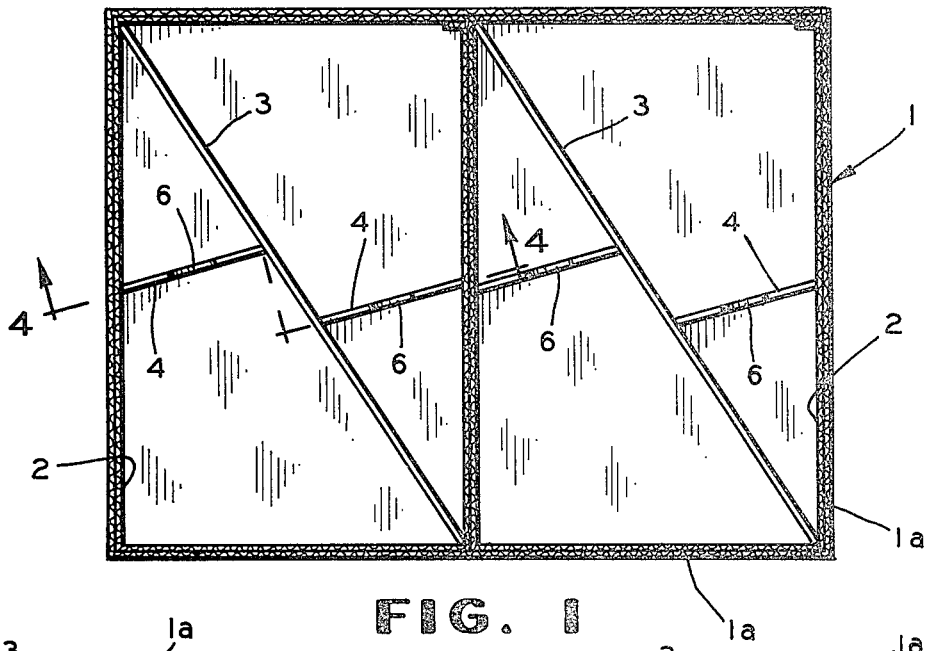
FIG. 1 shows a top plane view of a multi-compartment carton for finished or unfinished TV bulbs embodying this invention.

As illustrated in FIG. 1 the invention is embodied in a rectangular shipping box 1 comprising vertical side walls 1a, and bottom wall 1b. In use, the shipping box 1 would be provided with either top flaps or a standard corrugated lid, which are not shown in the drawings. A plurality of corrugated rectangular tubes 2 are inserted snugly within said rectangular box 1, in a side by side array, with the side walls of said vertical tubes 2 vertically disposed. The interior space of each such tube 2 is divided into equal compartments of triangular configuration by a vertical corrugated partition 3 extending diagonally between two corners of each said tube 2. Each partition 3 is cut and scored to form two integral flaps 4 which fold outwardly from the partition 3 in opposite directions. On each vertical partition 3 the scored vertical lines 4a on which the two flaps are folded outwardly are respectively equidistant from the nearest vertical edge of the partition 3. The two flaps 4 of each vertical partition 3 are folded outward to engage opposite vertical side walls of the corresponding tube 2. Each side wall so engaged has a vertical slot 5 cut to snugly receive the corresponding free end of each flap 4. A generally semi-circular section 6 is cut out of the top of each flap 4, to snugly engage the neck tubulation of a finished TV bulb 7, or an unfinished TV bulb 8, inserted in the respective triangular compartment of the vertical corrugated tube 2.

Figure 2:
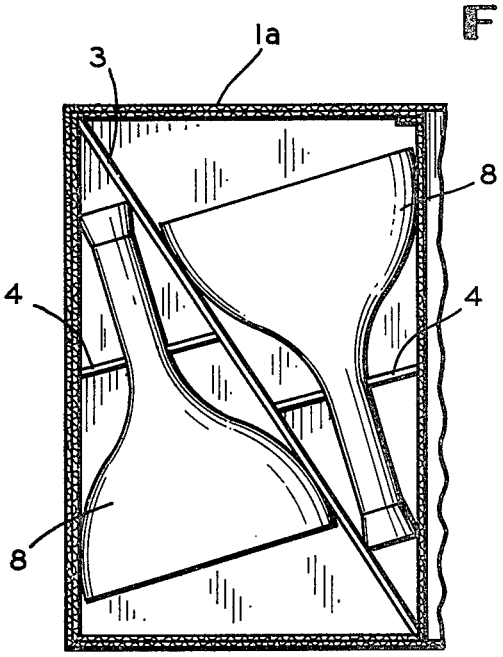
FIG. 2 shows a view of a portion of FIG. 1 with unfinished TV bulbs mounted therein, in a position for shipping.
Figure 3:
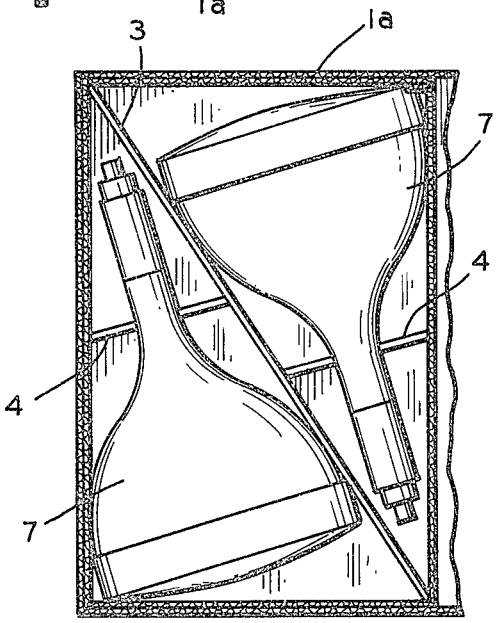
FIG. 3 shows a view of a portion of FIG. 1 with finished TV bulbs mounted therein in a position for shipping.
Figure 4:
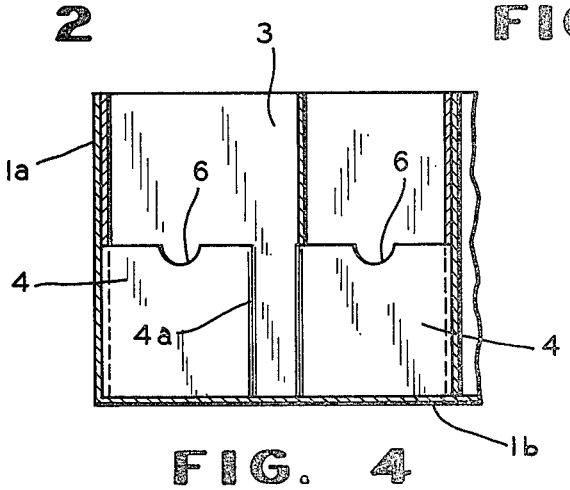
FIG. 4 shows a sectional view taken on plane 4—4 of FIG. 1.
Figure 5:
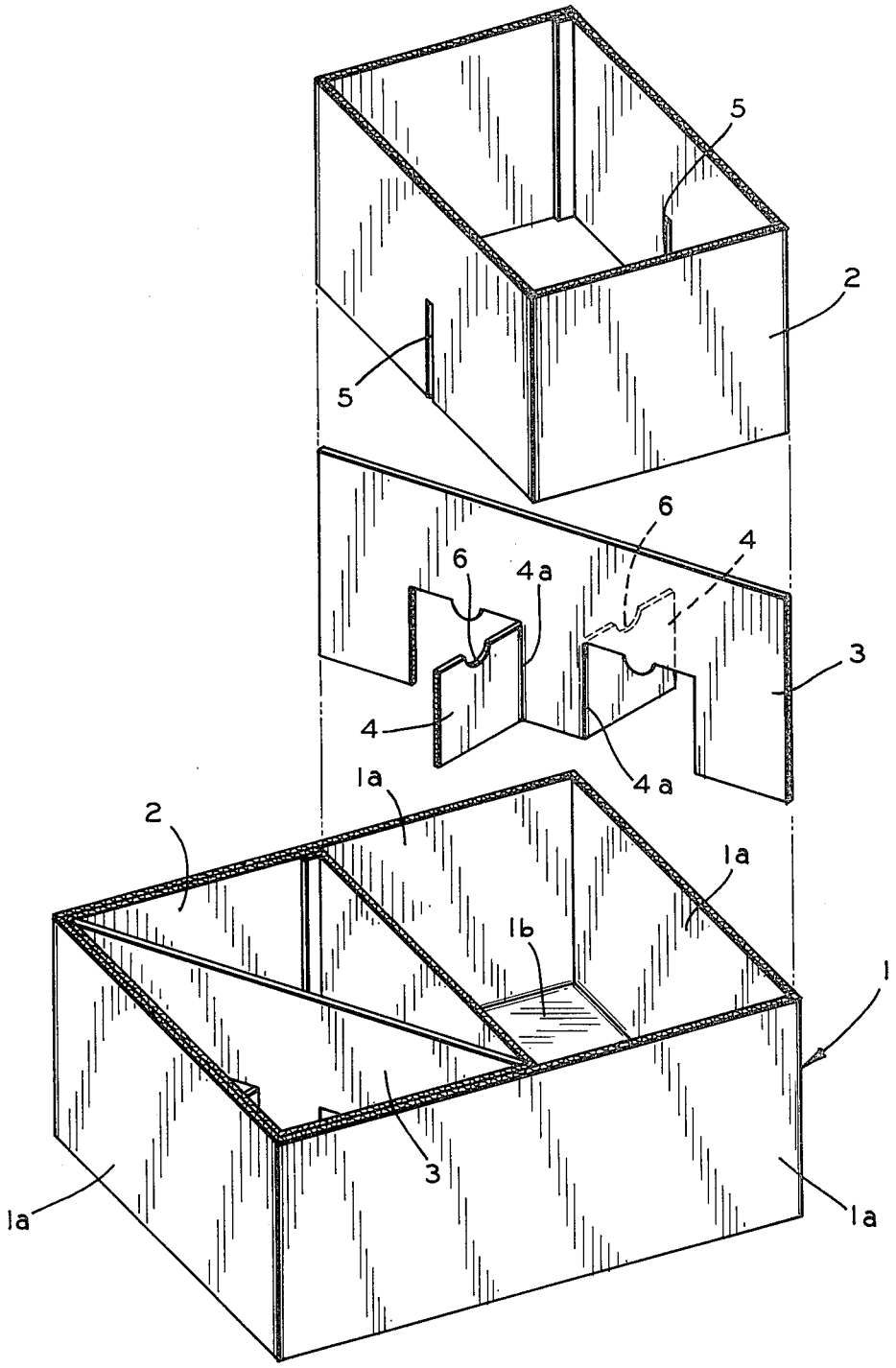
FIG. 5 is an exploded perspective view of the reshipper box of FIG. 1.

As shown in FIG. 2, the assembled reshipper carton will hold one unfinished TV bulb 8 in each triangular compartment. As shown in FIG. 3, the assembled reshipper carton will also accomodate one finished TV bulb 7 mounted in each triangular compartment. In either case, the bulbs 7 or 8 are firmly supported within the respective triangular compartments, to withstand the normal shocks and vibrations encountered in shipping and handling.

Those skilled in the art can appreciate that the invention could also be incorporated in a single wall shipping box, without the use of the vertical rectangular tubes.

Although the invention has been described in terms of specified embodiments which are set forth in detail, it should be understood that this is by illustration only and that the invention is not necessarily limited thereto, since alternative embodiments will become apparent to those skilled in the art in view of the disclosure. Accordingly, modifications are contemplated which can be made without departing from the spirit of the described invention.

What is claimed is:

1. A carton for a pair of TV bulbs or funnels having a large rectangular end tapering down to an integral neck tubulation, comprising:

1. a corrugated box having a bottom and four vertical side walls disposed in rectangular relationship;
2. a vertical corruguated partition extending diagonally between two corners of said side walls, thereby dividing the box space into two equal compartments of triangular configuration;
3. a pair of integral flaps respectively formed in said partition and swung horizontally outwardly from opposite sides of said partition to respectively traverse said compartments and contact opposed side walls of said box; and 4. means on each said flap for engaging the neck tubulation portion of a TV bulb or funnel inserted in the respective compartment to secure same for shipment.

2. The carton of claim 1 wherein said triangular compartments are sized to receive either an unfinished TV bulb without face plate or a finished TV bulb with face plate.

3. The carton of claim 1 or 2 wherein said means on said flap comprises a circular notch sized to receive the neck tubulation of the TV bulb.

4. The carton defined in claim 1 or 2 wherein said opposed side walls of the box have vertical slots therein to respectively receive the free ends of said flaps.

5. The carton defined in claim 1 or 2 wherein the pivoted vertical edges of said flaps are respectively located equidistant fom the adjacent vertical edges of said partition whereby each said flap engages the same portion of the neck tubulation of a TV bulb or funnel inserted in the respective triangular compartment.

6. A carton for a plurality of pairs of finished or unfinished TV bulbs or funnels of the type having a large rectangular viewing end tapering down to an integral neck tubulation, comprising:

1. an outer box of elongated rectangular configuration, having a bottom wall and vertical side walls;
2. a plurality of rectangular corrugated tubes snugly mounted in side by side relationship in said outer box with the walls of said tubes being vertically disposed;
3. a vertical corrugated partition extending diagonally between corners of said tube side walls, thereby dividing the tube space into two equal compartments of triangular configuration.
4. a pair of integral flaps respectively formed in said partition and swung horizontally outwardly from opposite sides of said partition to respectively traverse said compartments and contact opposed side walls of the respective tube; and
5. means on each said flap for engaging the neck tubulation portion of a TV bulb or funnel inserted in the respective compartment to secure same for shipment.

7. The carton of claim 6 wherein said means on said flap comprises a circular notch sized to receive the neck tubulation of the TV bulb or funnel therein.

8. The carton defined in claim 6 wherein said opposed walls of each said tube have vertical slots therein to respectively receive the free ends of said flaps.

9. The carton defined in claim 6 wherein the pivoted vertical edges of said flaps are respectively located equidistant from the adjacent vertical edges of said partition whereby each said flap engages the same portion of the neck tubulation of a TV bulb or funnel inserted in the respective triangular compartment.

10. A carton for a plurality of pairs of finished or unfinished TV bulbs or funnels of the type having a large rectangular viewing end tapering down to an integral neck tubulation, comprising:

1. an outer box of elongated rectangular configuration, having a bottom wall and vertical side walls;
2. a plurality of rectangular corrugated tubes snugly mounted in side by side relationship in said outer box with the walls of said tubes being vertically disposed;
3. a vertical corrugated partition extending diagonally between corners of said tube side walls, thereby dividing the tube space into two equal compartments of triangular configuration; and
4. a pair of integral flaps respectively formed in said partition and swung horizontally outwardly from opposite sides of said partition to respectively traverse said compartments and contact opposed side walls of the respective tube.

11. The carton defined in claim 10 wherein said opposed walls of each said tube have vertical slots therein to respectively receive the free ends of said flaps.

12. The carton defined in claim 10 which includes means on each flap of said pair of integral flaps for engaging the neck tubulation portion of a TV bulb inserted in the respective compartment to secure same for shipment.

13. The carton defined in claim 1, 6 or 10 wherein said flaps include a lower edge in contact with said bottom wall, and an upper edge spaced below the top edges of said vertical side walls.

14. The carton defined in claim 1, 6 or 10 wherein said flaps include a circular notch formed on the upper edge of said flaps, sized to receive the neck tubulation of the TV bulb or funnel therein.

15. The carton defined in claim 1, 6, or 10 wherein said opposed vertical side walls in contact with said flaps have vertical slots formed therein to respectively receive the free ends of said flaps.

* * * * *